United States Patent [19]

Wetmore

[11] Patent Number: 4,604,001

[45] Date of Patent: Aug. 5, 1986

[54] JACKDOWN TENSION LEG PLATFORM

[75] Inventor: Sherman B. Wetmore, Westminster, Calif.

[73] Assignee: Global Marine Inc., Houston, Tex.

[21] Appl. No.: 587,591

[22] Filed: Mar. 8, 1984

[51] Int. Cl.[4] ..... B63B 21/50; B63C 11/34; E02B 17/08; E21B 7/128

[52] U.S. Cl. ..... 405/224; 405/189; 405/197; 114/265; 166/356; 166/366; 175/7

[58] Field of Search ..... 405/169, 170, 185, 188, 405/189, 192, 194, 195-200, 203-205, 224, 227; 114/264, 265, 293; 166/356, 366; 175/7, 8

[56] References Cited

U.S. PATENT DOCUMENTS

| | | | |
|---|---|---|---|
| 2,953,904 | 9/1960 | Christenson | 405/196 |
| 3,353,364 | 11/1967 | Blanding et al. | 405/189 |
| 3,391,734 | 7/1968 | Townsend, Jr. | 166/0.5 |
| 3,472,032 | 10/1969 | Howard | 405/210 |
| 3,540,396 | 11/1970 | Horton | 114/265 |
| 3,556,218 | 1/1971 | Talley et al. | 166/265 |
| 3,837,309 | 9/1974 | Biewer | 114/265 |
| 3,982,401 | 9/1976 | Loggins | 175/7 X |
| 3,988,898 | 11/1976 | McDonald | 405/224 |
| 4,010,798 | 3/1977 | Corgnet | 166/0.5 |
| 4,378,848 | 4/1983 | Milberger | 166/366 X |
| 4,395,160 | 6/1983 | deJong | 905/198 X |
| 4,425,056 | 1/1984 | Hunter | 405/197 X |
| 4,479,401 | 10/1984 | Korkut | 405/198 X |
| 4,482,274 | 11/1984 | Brandi et al. | 405/224 |

*Primary Examiner*—Cornelius J. Husar
*Assistant Examiner*—Nancy J. Stodola
*Attorney, Agent, or Firm*—Christie, Parker & Hale

[57] ABSTRACT

A jackdown tension leg platform is set forth which may be used for processing a commodity liberated from the ocean floor by one or more wells. The platform includes a closed buoyant hull which houses production equipment and at least one connector disposed on the hull for vertical relative movement. The connector has one end secured to the ocean floor and is moved upwardly relative to the hull to submerge the hull to a depth below the majority of the ocean's hydrostatic forces and, at the same time, tension the connector to hold and stabilize the hull over the wells. Conduits are connected between the wells and the submerged hull and between the hull and the surface. A crew module may be provided above the surface atop the connector with a trunk disposed between the module and submerged hull to provide access therebetween. Additionally, where the commodity is combined at a manifold located in a closed ocean floor mounted shell, a descending and ascending capsule may be provided to transport crew members between the shell and submerged hull.

27 Claims, 11 Drawing Figures

48
54
60
62
64
56
79
78
76
80
22
73
44
66
72
20

JACKDOWN TENSION LEG PLATFORM

FIELD OF THE INVENTION

This invention relates to submersible structures and more particularly to submersible production facilities.

BACKGROUND OF THE INVENTION

Throughout the world, numerous offshore reserves of oil and gas have been discovered and developed. This trend of discovering, drilling, and developing offshore fields of oil and gas is expected to continue and accelerate as the demand for energy increases and fields on the land become depleted or otherwise economically unattractive.

After an offshore reserve has been discovered and tested, it is necessary to drill one or a number of production wells to remove the oil and/or gas. Typically, at any one offshore well site, a number of wells will be spaced closely together so as to facilitate drilling and collection of the commodity. The commodity, oil and/or gas, removed from the reserve by the wells requires at least some processing before loading onto a surface vessel such as a tanker. Accordingly, it has been known to moor a surface production vessel above the well site to receive and at least partially process the oil or gas from the well.

Mooring a surface vessel at sea encounters several drawbacks. One drawback is that a surface vessel is exposed to forces of waves, wind and surface currents, all of which are most pronounced at or near the ocean's surface. Adverse weather such as hurricanes, typhoons, or the like, increase the surface forces. To moor the surface vessel, therefore, requires a number of strong mooring lines. These lines must not only be able to withstand the forces generated by the surface forces, but also must be capable of being put in tension to hold the vessel over the site. For well sites in relatively deep water, on the order of 250 feet, the length and required strength of the mooring lines makes mooring of surface production vessels expensive and otherwise unattractive. Additionally, separate winching devices must typically be provided and controlled to tension the mooring lines and hold the vessel over the site. Furthermore, in severe weather, the vessel may have to be moved to a safer location.

Partially submerged vessels such as those referred to as semi-submersibles and described in Corgnet, U.S. Pat. No. 3,961,490 have somewhat reduced the effects of surface forces on production vessels. However, stabilizing the semi-submersible over a discrete location on the sea floor still requires mooring or means for dynamically maintaining the position of the vessel such as by thrusters or the like. If mooring is required, heavy mooring lines must be provided and must be maintained in sufficient tension by winching mechanisms to resist movement of the semi-submersible. Due to the surface forces, the mooring lines must be made strong not only to withstand tensioning, but also the aforesaid surface forces. In relatively deep well sites, the use of mooring lines from an economical point of view becomes unattractive. Again, severe weather may require leaving the site. Accordingly, there is a need to provide a production facility which is not subject to the surface forces and which can be quickly and easily moored over the well site.

Another drawback of prior production facilities relates to the ocean floor valve manifolds which collect and combine the oil or gas from a number of wells to a common riser extending upward to the facility. The manifolding, commonly referred to as a "christmas tree", is typically located in a closed shell at the ocean floor. To service the christmas tree, submarine-type vessels are required to travel from the surface to the shell to transport servicing crews. Submarines are expensive and, especially in rough seas, must be stored on board the vessel when not in use. There is a need, therefore, to provide a means for simple access to a ocean floor mounted shell.

SUMMARY OF THE INVENTION

There is, therefore, provided in the practice of this invention a tension leg production platform which is submersible to a desired depth to avoid the majority of forces and which quickly and easily tensions its moorings to stabilize the platform in a submerged state a substantial distance above the ocean floor well site. Furthermore, a simple means to transport crews to a shell mounted on the ocean floor is provided.

Accordingly, the platform includes a buoyant closed hull housing production equipment. Disposed on the hull for relative movement are tensile connectors and means for moving the connectors relative to the hull. Each connector has ends adapted to be secured to the ocean floor to moor the platform.

To moor the platform over the ocean floor site, the platform is floated to position over the site. The connectors are lowered from the hull and the ends are secured to the ocean floor. Moving the connectors relative to the hull in an upward direction in effect jacks down and submerges the platform and, due to the buoyancy of the platform, tensions the connectors. Preferably, the platform is submerged to a depth below the level of the majority of the surface forces, such as, for example, 150 to 200 feet. At this depth, the platform encounters only subsurface currents which typically are small and steady compared to the variable surface forces. Furthermore, severe weather conditions have only a minimal effect on the platform. Tensioning of the connectors maintains the platform over the ocean floor well site.

The connectors may be embodied as legs mounted to the hull for relative upward (jackup) and downward (jackdown) movement, each having a tendon which may be a string of assembled pipe extending downward for connection to the sea floor. After the hull has been submerged, since the ends of the legs opposite the tendons extend above the surface, one or more of the legs can support housing modules and access and utility trunks extending from the surface to the platform. Air and exhaust are transported via the utility trunks between the hull and the surface. Those legs not supporting above-surface facilities may be removed or folded down to further minimize the effects of surface forces and permit greater shipping access to the platform.

To access the ocean floor shell having the christmas tree piping and valves, a crew capsule is provided. The capsule is entered from the submerged platform and is moved in descent and ascent along guide lines to and from the shell. Accordingly, access to the shell for servicing equipment is provided without requiring expensive submarine-type vessels.

BRIEF DESCRIPTION OF THE DRAWINGS

These and other features and avantages of the present invention will be appreciated as the same becomes better understood by reference to the following detailed description of the presently preferred embodiments when considered in connection with the accompanying drawings wherein:

FIG. 11 is a top view of tension leg platform according to the present invention.

DETAILED DESCRIPTION

Figure 1:
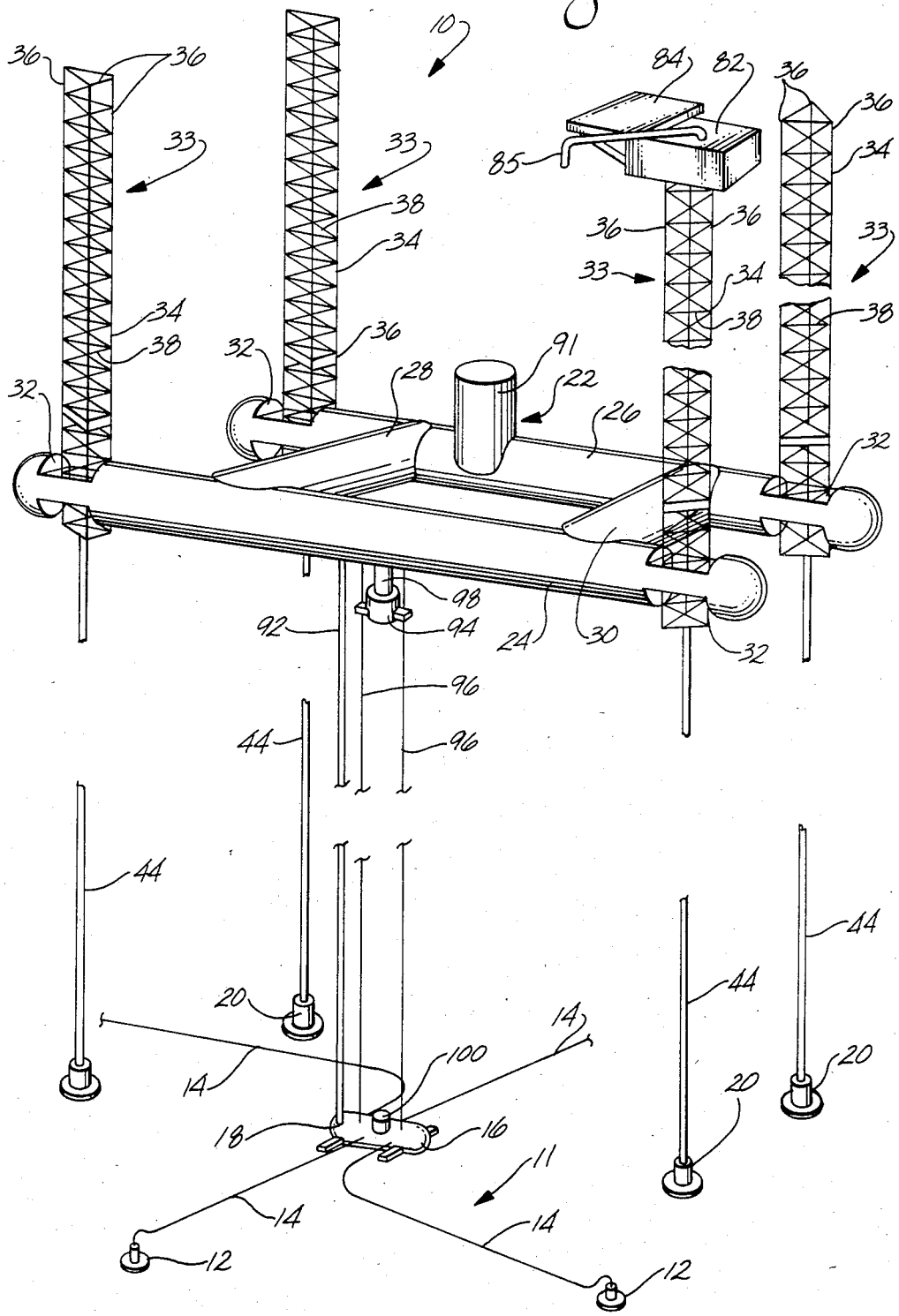
FIG. 1 is a perspective side view of the submerged tension leg platform of the present invention.

Turning to FIG. 1, a tension leg platform 10 according to the present invention is shown. While the following description is directed to a platform adapted for use in oil production, it is to be understood that the platform could be used for other purposes. The platform 10 is to be used in conjunction with one or more established wells, defining a well site 11, each well having a well head shown generally as 12. From each well head 12 a supply line 14 extends to a sea floor mounted closed shell 16. The shell 16 houses valving and manifolding commonly referred to as "christmas trees" for the various supply lines 14. The interior of the shell 16 is maintained free of the sea water to provide a closed but accessible chamber for servicing of the christmas trees. Outputs from the well heads 14 are combined to a single outlet connection 18 accessible from the outside of the shell 16.

To remove, process, and deliver the oil and/or gas to transport vessels from the well heads 12, the production platform 10 is used. To provide secure moorings for the platform 10, a number of bases 20, shown as being four in number in FIG. 1, are secured at the site to the sea floor by pilings or the like. Each of the bases 20 serves as a secure sea floor connection point or anchor and has a stab-type latch mechanism (not shown) the purposes of which will hereinafter become evident.

Figures 4, 5, 6, 7, 8, 9, 10:
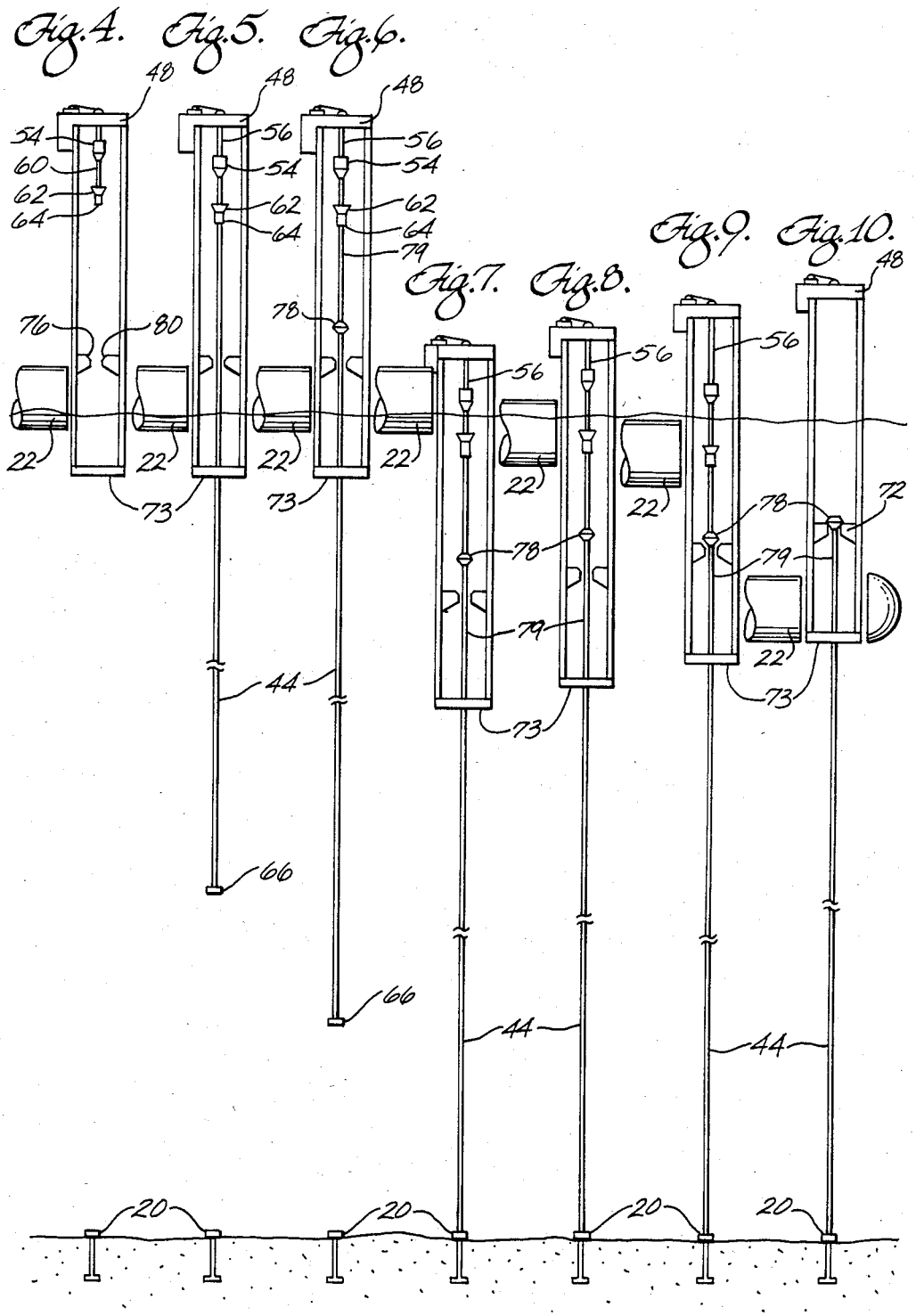
FIGS. 4 through 10 are schematic side views of the platform of the present invention showing the steps of a preferred method for installing the platform.

The platform 10 includes a closed, positively buoyant, submersible hull 22 having tubular longitudinal members 24 and 26, spaced apart by horizontal tubular cross members 28 and 30. It is to be understood that the configuration of the hull 22 shown in the drawings and described herein is not considered to be limiting. Various other shapes of hulls could be used. The hull 22 may be designed as shown in the drawings, to provide a submersible habitat, support equipment or other structures. The hull 22 is typically constructed at a suitable onshore facility and is equipped to house well processing equipment such as manifolds, process separators, injection pumps, and gas compressors or the like, along with access and utility galleries permitting personnel to service and monitor and provide power and control to the process equipment. Due to the closed hollow nature of the hull 22, it is buoyant and therefore can easily be floated and towed to the well site 11. As seen in FIGS. 1 and 9, the longitudinal members 24 and 26 are provided at their ends with vertically arranged rectangular openings 32, the purposes of which will hereinafter become evident. To prevent water from entering the hull 22 the walls of the openings 32 are closed.

Disposed in each opening 32 for vertical relative movement is a tensile member shown as a connector 33 including a truss leg 34 which preferably is of the LeTourneau type commonly used in jackup offshore drilling platforms. Each leg 34 has three vertically extending main beams 36 supported by and supporting a network of cross beams 38. Extending from each leg 34 each connector 33 also includes a tendon 44 which may be embodied as an assembled string of pipe. Each tendon is of a length to extend from the leg 34 for connection to a base 20 as described in detail below.

Figure 3:
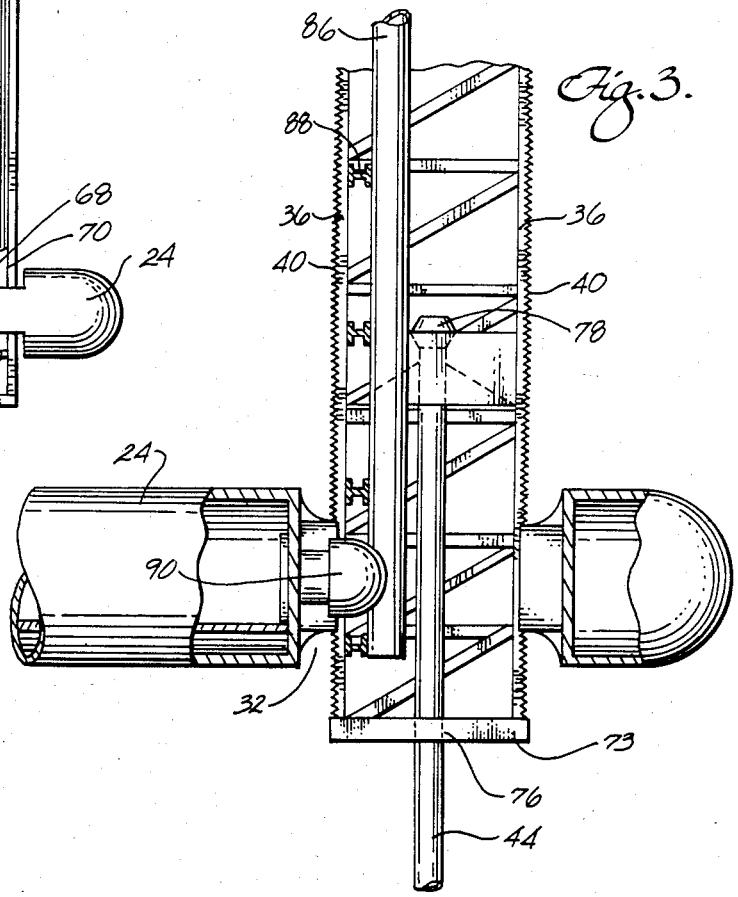
FIG. 3 is an enlarged side view of a portion of the platform of the present invention showing the relative positions of a leg and the platform in a submerged position of the hull.

To move the legs 34 relative to the hull 22, each of the main beams 36 is provided with toothed racks 40 as shown in FIG. 3. The main beams 36 and their racks 40 are received and supported by drive means disposed in the openings 32 shown in FIG. 11 as hydraulic jacking mechanisms 42. Each jacking mechanism 42 includes at least one driveable pinion (not shown) in engagement with the rack 40. The pinions of each jacking mechanism 42 are driven by appropriate hydraulic devices in synchronism to permit the legs 34 to move downward (platform jackup) or drive the legs 34 upward (platform jackdown) relative to the hull 22. The jacking mechanisms 42 preferably are of the same type as are commonly used on jackup offshore drilling platforms. The several jacking mechanisms 42 are separately operable.

Figure 2:
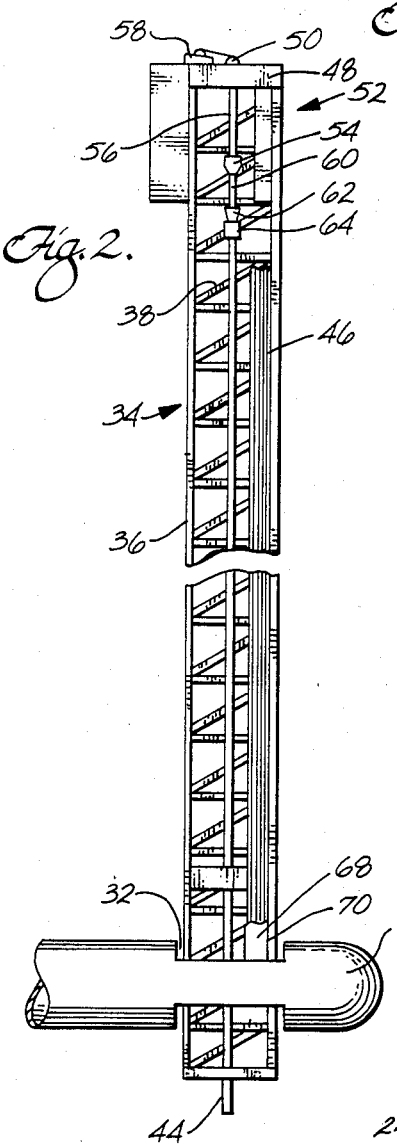
FIG. 2 is a side view of one of the legs of the platform of FIG. 1 with the leg in a raised position relative to the submersible hull.
Figure 1:
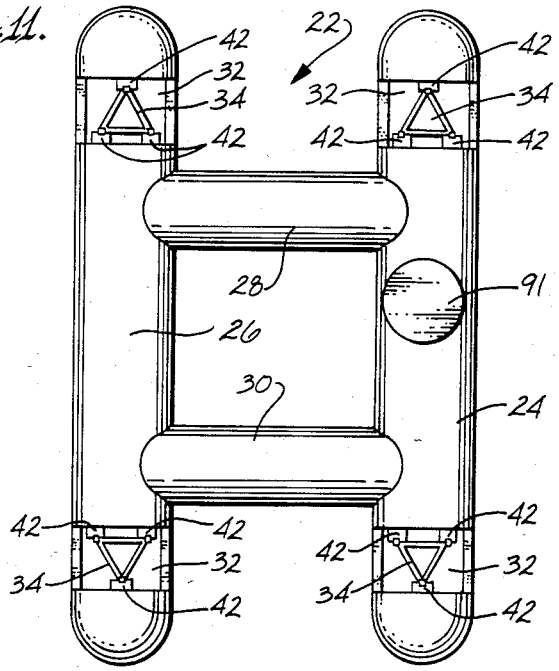

To secure platform 10 to the sea floor at the well site 11, each connector 33 also includes a tendon 44. The tendons 44 are assembled at the site 11 from 120 foot long sections of pipe that are screwed or clamped together to achieve the desired length. As shown in FIG. 2, lengths of pipe for assembly into the tendons 44 may be stored in the upright position in hangers 46 within the legs 34. Of course, shorter pipe sections can also be used.

Where the tendons 44 are to be pipe sections threaded together, each leg 34 is provided, as shown in FIG. 2, with an upper support 48 mounting a rotatable crown block 50 of a pipe assembly mechanism 52. In a well known fashion, the assembly mechanism 52 includes a traveling block 54 and a cable 56 extending about the crown block 50 and traveling block 54. One end of the cable 56 is fixed to the upper support 48 while the other end is connected to a winch 58. Accordingly, operation of the winch 58 raises and lowers the traveling block 54 relative to the upper support 48.

Connected to the traveling block 54 is a heave compensator shown schematically as 60. The heave compensator 60 may be of the type shown and described in U.S. Pat. No. 3,905,580 issued Sept. 16, 1975 to David William Hooper. The heave compensator 60 is controlled to extend and contract to counteract heave and other vertical motions of the hull 22 to permit the tendons 44 to be assembled by the pipe assembly mechanism 52, and to be connected to bases 20, unaffected by such motions. One end of the heave compensator 60 is connected to the traveling block 54 and the other end is connected to a powered, rotatable swivel 62. To enable the pipe assembly mechanism 52 to pick up a section of pipe, the assembly mechanism 52 includes an elevator 64 also of known construction secured to the swivel 62 and adapted to grasp and release an end of the pipe.

To assemble the tendons 44 an initial length of pipe is lifted from a pipe hanger 46 by the assembly mechanism 52. The initial length of pipe has fashioned at one end a suitable structure shown schematically in FIGS. 4–10 as a stab-type connector 66 adapted to mate with and be latched by the floor mounted bases 20. The initial length of pipe is positioned over and is lowered through a support plate 70 of each leg as shown in FIG. 2. A bearing block 72 is disposed above a bottom support 73, the bearing block 72 and bottom support 73 having a common bore 76, to pass the pipe during assembly of the tendons 44 as shown in FIG. 3. When the initial length is lowered into position so that the elevator 64 is near the support plate 70, the winch 58 is deactivated and the lowering of the traveling block 54 by the assembly mechanism 52 is stopped. The initial length of pipe is held by an appropriate grasping means such as slips interposed between the pipe and the support plate 70 and is thereafter released from the elevator 64. The winch 58 is operated to raise the elevator 64 which is moved to and withdraws an additional length of pipe from the hanger 46. The additional length of pipe is positioned over and is mated to the additional length of pipe. The powered swivel 62 rotates the additional length which, in turn, threads the mating ends of the pipe together. In lieu of providing the powered swivel, the swivel may be freely rotatable and power tongs or the like may be used to rotate the additional lengths for connecting the pipe. The foregoing procedures are performed with hull 22 floating on the water surface and with legs 34 fully elevated relative to the hull, so that all work locations are above the water surface. These procedures are repeated, as necessary, until the desired length of tendon 44 is obtained. The desired length is such that the combined length of the legs 34 and tendons 44 is sufficient to extend from a position above the surface of the ocean to the bases 20. For example, for a platform having legs with an approximate length of 250 feet, each tendon 44 should have a length to extend from a raised leg to a depth approximately 175 feet above the corresponding base 20.

When each of the last pipe sections have been connected to define tendons 44 extending from the raised legs to a predetermined, proper depth above the bases 20, a landing fitting 78 is attached to a final pipe section of the desired tendon 44. The landing fitting 78 is adapted to engage a socket 80 in the corresponding bearing block 72 and prevent the tendon 44 from moving downwardly with respect to the leg 34. To provide for heave compensation of each tendon 44, a lifting sub 79 is interconnected between the landing 78 and the elevator 64. Preferably, the lifting sub 79 has a length such that the landing fitting 78 is disposed above the bearing block 72 a distance suitable so as not to engage the bearing block 72 during heave compensation. For the platform described above having 250 foot legs, each lifting sub 79 is approximately 100 feet long and the landing fitting 78 is disposed to be spaced from the bearing block 72 by an average distance of 50 feet.

To position the platform 10, the hull 22 is floated into position over the site 11 as shown in FIG. 4. To facilitate movement of the hull 22 and reduce drag, the legs 34 are maintained in their raised position during such movement to the site. The tendons 44 are then assembled to extend beneath the hull 22 and legs 34 to the desired established length discussed above and shown in FIG. 6. The landing fitting 78 and lifting sub 79 are serially connected to the uppermost end of each tendon 44. Accordingly, as shown in FIG. 6, the tendons 44 are suspended by the heave compensators 60. Jacking down the legs 34 relative to the hull with the jacking mechanisms 42 lowers the legs 34 and their tendons 44 such that the stab connectors 66 at the lower end of the tendons 44 approach the bases 20.

Ultimately, the legs 34 are lowered to the position shown in FIG. 7 wherein the tendons 44 mate with and are latched to the bases 20. In the illustrative embodiment set forth above, jacking down the legs approximately 175 feet positions the connectors 66 for connection with the bases 20. Then a modest jackup sequence is used to fully extend or bottom out the heave compensator 60.

Full extension of the heave compensator 60 locates the landing fitting 78 a distance above the bearing support 72. Continued, modest jacking up of the legs 34, as shown in FIG. 8, partially submerges the hull 32 and at the same time tensions the tendons 44, cables 56 and associated equipment. The jacking up sequence gradually increases the tension in the tendons 44 until the tension in the cables 56 reaches a prescribed maximum. Thereafter, the winches 58 of each leg 34 pay out cable at a linear speed equivalent to the jack-up rate of the leg 34, maintaining the tendon 44 in tension and lowering the landing fitting 78 relative to the leg 34 for ultimate engagement with the bearing support socket 80 as shown in FIG. 9. After the landing fittings 78 seat on the bearing supports 72, the pipe assembly mechanisms 52, lifting subs 79 and associated equipment may be removed as desired to a nearby barge or the like.

Continued jacking up of the legs 34 results in further submergence of the hull 22 against its buoyant forces as shown in FIG. 9. Due to the attachment of the tendons 44 to the bases 20 at the sea floor, the positive upward buoyant forces urging the hull 22 in an upward direction toward the surface, increases the tension in the tendons 44 and legs 34 in which, in turn, holds and stabilizes the position of the platform 10 in position over the well site 11. Continued jacking up of the legs 34 submerges the hull 22 to a preferred depth of between 150 and 200 feet below the ocean surface. It has been determined that this depth is below the depth at which waves and surface currents have the most pronounced effect. Accordingly, locating the hull 22 below the majority of surface effects while at the same time tensioning the tendons 44, secures and stabilizes the position of the tension leg platform 10 over the well site. Furthermore, the tensioning of the tendons 44 is accomplished simply and easily by using the jacking mechanisms 42 which raise and lower the legs 34. Separate winching or tensioning mechanisms are not required. Since a great portion of the jacking up of the legs 34 to submerge the hull 22 occurs when the jacking mechanisms 42 are submerged, supply and return conduits may be provided on the legs 34 to supply hydraulic power to hydraulically actuated jacking mechanisms 42.

Returning to FIG. 1, when the hull 22 is submerged, the legs 34 project upward from the ocean surface. One of the legs either then includes or can then be fitted with a crew module 82 positioned atop the leg 34 to house the crew, control and monitoring equipment and the like. A helicopter deck 84 adjoins the crew module to accommodate transportation to and from the module 82. The module 82 also includes a tanker loading boom 85 for filling tankers positioned alongside the platform 10.

To provide personnel and utility access to the submerged hull 22, a trunk 86 is provided between the module 82 and the hull 22 as shown in FIG. 3. The trunk 86 is embodied as a hollow tube having a ladder, elevator or other means for personnel movement between the submerged hull 22 and the crew module 82. The trunk 86 may also house power, ventilation exhaust control and process lines. As can be appreciated by virtue of the trunk 86, breathing air can also be supplied to the submerged hull 22. Accordingly, costly equipment and methods for exhausting power equipment such as pumps and compressors and for providing breathing air are not required. Standard surface equipment, i.e., pumps and compressors can be used.

The trunk 86 is positioned and connected after the hull 22 has been submerged and is secured to the leg 34 by a number of mounts 88. To connect the trunk 86 to the hull 22, a latch door 90 is installed at the lower end of the trunk 86 by divers to interconnect the trunk 86 to the hull 22 and more particularly to one of the longitudinal members 24. Accordingly, as discussed above, fresh air is supplied to the hull 22 through the trunk 86 which also permits personnel access to the hull 22 and provides an accessible conduit for routing electrical cables, process piping and the like to and from the crew module 82 to the hull 22.

Once the hull 22 has been submerged, the remaining legs 34, not supporting the crew module 82 or trunk 86, may be severed from the hull 22 below the water line or, alternatively, may be provided with means to fold down the legs. In the preferred embodiment as shown in FIG. 1, removal or folding down of the three legs 34 not supporting the crew module 82 enables 360° surface vessel access to the solitary crew module 82.

In the event that major repairs or servicing are required for the hull 22 or the production equipment within the hull 22, it may be necessary to raise the hull 22 to a position nearer the surface. To do so, all legs 34 are reconnected or returned to the upright position as shown in FIG. 1 and the trunk 86 is disconnected from the hull 22. Actuating the jacking mechanisms 42, to controllably release or jackdown the legs 34, moves the hull 22 gradually toward the surface.

Near the surface, the jackdown of the legs 34, i.e., raising of the hull 22, is stopped so as to maintain the tendons 44 in tension. To provide access to the hull 22 a relatively short, upwardly projecting closeable snorkel 91 is provided on the hull 22 to extend to a position above the water surface. Repair personnel, equipment, and the like travel from the surface to the hull 22 through the snorkel 91 to effect the desired repairs. After completion of servicing or repairs, the snorkel 91 is closed and hull 22 is again submerged by actuating the jacking mechanisms 42 to jack up the legs 34 in the manner described above.

It is to be understood that while the above description of the platform 10 is directed toward the embodiment wherein each connectors 33 consists of a leg 34 and a tendon 44, that other types of tensile connectors may be used. For example, each connector 33 may be embodied as a cable or wire rope, one end of which is anchored to the sea floor, the other end attached to a winch on-board the hull 22. Operation of the winch would move the cable or wire rope relative to the hull 22 to submerge or surface the hull 22. The connectors 33 could also be embodied as chains, one end of which are attached to the sea floor, the other end attached to winches on-board the hull 22. Again, operation of the winches would move the chains relative to the hull 22 to submerge or surface the hull 22. Alternatively, the connectors 33 may comprise any combination of legs 34, pipe, cable, wire rope or chain as preferred.

Furthermore, for the embodiment described above, it is to be understood that the pipe assembly mechanism 52 should not be deemed to be limiting. For example, mechanisms such as that described in U.S. Pat. No. 3,949,883 issued Apr. 13, 1976 to Crooke et al and entitled "Hydraulically Operated Heavy Lift System for Vertically Moving a String of Pipe" which, in a continuous fashion, assembles a string of pipe may be used.

As seen in FIG. 1, the combined flows from the various well heads 12 combined by the christmas tree piping in the shell 16 is supplied to the hull 22 through a common riser 92. While the riser 92 may be installed prior to submerging of the hull 22, the preferred method is to connect the riser 92 between the hull 22 and shell 16 subsequent to submerging the hull 22 by using divers or a submersible vehicle. The riser 92 is connected to the shell outlet connection 18 and is provided with a disconnect, either at its connection to the hull 22 or to the shell outlet connection 18, to free the hull 22 to be raised back to the surface for major repairs or servicing as described above.

To service the shell 16, the hull 22 may also be provided with a capsule 94 guided by guidelines 96 attached between the hull 22 and the shell 16, the capsule 94 ascending or descending along the guidelines 96 between the hull 22 and the shell 16. Should servicing within the closed shell 16 be required, crew members would enter the capsule 94 through a chamber 98 on the hull 22, and close the capsule 94. The capsule is then lowered from the hull along the guidelines 96 for engagement with a shell airlock 100 permitting entry into the shell 16. When servicing is completed, the crew members reenter the capsule 94 through the shell airlock 100, and signals for the capsule to be raised along the guidelines back to the hull 22. Accordingly, powered vehicles such as submarines or the like are not required to reach the shell 16 for servicing.

While I have shown and described certain embodiments of a tension leg platform 10, it is to be understood that many modifications may be made without departing from the scope and spirit of the invention as set forth in the claims. For example, the hull 22 may have a different configuration than that shown on the drawings and may be provided with more or fewer legs for submerging and raising the hull. Additionally, the tendons may be prefabricated and positioned on the bases, the tendons being grasped by the legs when lowered to permit the hull to be submerged and the tendons to be tensioned. Furthermore, the hull 22 may be provided with means to ballast the hull 22 to control its buoyancy and thereby the tension on the tendons 44.

What is claimed is:

1. An operations facility useful over an underwater site comprising:

a positively buoyant, fully submersible hull structure;

a plurality of connectors each disposed on the hull for movement vertically relative to the hull, each connector including means at its lower end for connecting the connector to an anchor disposed at the site; and means coupled between the hull and the connectors at the hull for moving each connector to attach the lower end with the anchor and thereafter for moving the hull downwardly along the connected connectors to submerge the hull to a desired depth wholly below the water surface and to tension the connectors.

2. The facility of claim 1 wherein each connector includes an upper leg portion and a tendon extending from the leg portion to the underwater site and the coupling means includes means between the hull and each leg portion for moving the leg portion relative to the hull.

3. The facility of claim 2 wherein each tendon consists of a length of pipe.

4. The facility of claim 3 wherein the length of pipe includes pipe segments assembled to define each tendon.

5. The facility of claim 1 wherein the moving means includes a jacking mechanism disposed on the hull and a cooperative rack disposed on the connector.

6. A tension leg operations facility for processing a commodity received from wells at an ocean floor site comprising:

a positively buoyant, fully submersible closed hull substantially defining the facility and housing commodity processing equipment;

a plurality of anchoring bases affixed at the ocean floor site;

a plurality of connectors disposed on the hull for substantially vertical movement relative to the hull, each connector having means at a lower end thereof for attaching the connector to an anchoring base;

means at the hull operable for moving the connectors relative to the hull into attachment of the connector lower ends to the anchoring bases and for moving the hull downwardly along the attached connectors from a floating state to a fully submerged state a selected distance below the ocean surface, the buoyancy of the hull tensioning the connectors to hold the submerged hull over the site; and means for supplying the commodity to and discharging the commodity from the submerged hull.

7. The facility of claim 6 wherein each connector includes a leg vertically disposed on the hull for relative movement and a tendon having one end securable to a base and the other end attached to the leg.

8. The facility of claim 6 wherein the means for moving the connector and the hull relative to each other includes a jacking mechanism disposed on the hull and a cooperative rack on each connector to move the connector relative to the hull.

9. The facility of claim 6 wherein at least one of the connectors has another end projecting above the ocean surface, the facility further including a personnel module mounted to said connector another end and an access trunk extending between the module and the hull.

10. A method for establishing a production facility over wells at an underwater site comprising:

floating a positively buoyant, fully submersible hull substantially defining said facility and housing production equipment to a position over the site;

lowering and positioning each of a plurality of connectors from the hull to the site to mate the lower ends of the connectors with bases anchored at the underwater site;

attaching the lowermost ends of the connectors to the bases;

moving the connectors upwardly relative to the hull to submerge the hull to a position wholly below the water surface and to tension the connectors; and connecting at least one supply line from the well to the submerged hull.

11. The method of claim 10 wherein a connector is adapted to extend above the water surface, the method further including mounting a personnel module atop the connector to house personnel.

12. The method of claim 11 further including interconnecting a trunk between the module and submerged hull to provide access therebetween.

13. A method for establishing a production facility over wells located at an ocean floor site comprising:

floating a closed, buoyant hull substantially defining said facility and housing production equipment to a position over the site, the hull having a plurality of legs disposed for vertical movement relative to the hull;

assembling a tendon to extend from each leg toward the site;

jacking each leg downwardly relative to the hull to secure the lower end of each tendon to the ocean floor;

securing the other end of each tendon to the respective leg;

jacking each leg upwardly relative to the hull to submerge the hull to a desired depth below the ocean surface and to tension the leg and the respective tendon;

interconnecting a supply conduit between the submerged hull and the wells to provide communication between the wells and the hull; and attaching a line between the submerged hull and the ocean surface to provide communication between the hull and the surface.

14. The method of claim 13 wherein assembly of the tendon includes coupling sections of pipe together.

15. The method of claim 13 wherein said desired depth of between 150 and 200 feet.

16. The method of claim 13 further including mounting a module atop a leg projecting above the ocean surface to house personnel.

17. The method of claim 16 further including positioning a closed trunk between the module and hull to provide access therebetween.

18. A tension leg facility for processing a commodity from wells at an ocean floor site, the commodity from the wells being collectable by a manifold located in a hollow ocean floor mounted shell, the facility comprising:

a buoyant closed hull substantially defining the facility and housing processing equipment;

a plurality of connectors movably carried by the hull, each connector having means at an end for attaching the connector to bases anchored at the ocean floor;

means for moving each connector relative to the hull to connect said attaching means to a base and for submerging the hull to a desired depth below the ocean surface by moving the connector upwardly relative to the hull, the buoyancy of the hull tensioning the connectors to stabilize the hull over the shell;

a supply riser interconnected between the submerged hull and the manifold at the shell to supply the commodity to the hull;

a closed capsule adapted to carry one or more crew members from the hull to the shell for servicing the manifold and ascending back to the hull; and means to guide the descent and ascent of the capsule.

19. The facility of claims 18 wherein the hull and shell are provided with airlocks for crew transfer to and from the capsule.

20. The facility of claim 18 wherein the guide means are a pair of cables extending between the hull and the shell.

21. A method for establishing a submerged facility a selected distance below an ocean surface and a substantial distance above a selected site on the ocean floor, comprising the steps of:

floating a positively buoyant closed facility to a position over the site;

establishing at least one anchor location on the sea floor in a selected relation to the site;

connecting an elongate tensile member between each anchor location and the floating facility;

moving the facility downwardly along the tensile members against the positive buoyancy of the facility sufficiently to locate the facility at the selected distance wholly below the ocean surface; and securing the facility against upward movement relative to the tensile member.

22. A subsurface hydrocarbons production facility for use with a subsea hydrocarbon production well comprising:

a plurality of anchor points securely attached to the sea floor in a predetermined pattern relative to the well;

a plurality of elongate tensile members connected at lower ends thereof to the anchor points and extending upwardly to a location substantially above the sea floor and a selected distance below the sea surface;

a positively buoyant habitable hull member defining said facility and connected to the upper ends of the tensile member at said location and held by the tensile members in a fully submerged state at the location said selected distance below the water surface, and means operable from the submerged hull structure for establishing a desired communication with the well.

23. A buoyant operations facility submersible over an underwater site at a selected depth below the water surface and a selected distance above the site comprising:

a positively buoyant, fully submersible hull structure substantially defining said facility and containing equipment for performing specified functions in respect to the site;

at least one vertically disposed connector carried by the hull for movement vertically relative to the hull, the connector including means at a lower end thereof for attaching the connector to a cooperating anchor means at the site, drive means at the hull and carried thereby operable for moving the connector downwardly relative to the hull into connection of the attaching means with the anchor means and for moving the positively buoyant hull downwardly along the connected connector thereby to fully submerge the hull to the selected depth below the water surface and to tension the connector.

24. The facility of claim 23 wherein the connector includes a tendon having a length substantially equal to the distance between the site and the selected depth and a carrier connected to an upper end of the tendon, said drive means operable to move the carrier.

25. The facility of claim 24 wherein the carrier is a vertically disposed leg having a length at least equal to the distance between the water surface and the selected depth.

26. The facility of claim 24 further including means for securing an upper end of the tendon to the hull against downward movement of the tendon relative to the hull.

27. A method for establishing a submerged operations facility over an underwater site comprising:

floating a positively buoyant, fully submersible hull substantially defining the facility to a position over the site;

lowering a plurality of connectors from the hull to the site and into attachment of lower ends of the connectors to a base anchored at the site; and moving each connector upwardly relative to the hull to drive the hull downwardly therealong from a floating state to submerge the hull wholly below the water surface, and securing the hull in a wholly submerged state to the connectors thereby to tension the connectors.

* * * * *